US006026956A

United States Patent [19]

Jensen et al.

[11] Patent Number: 6,026,956

[45] Date of Patent: Feb. 22, 2000

[54] PACKAGES WHICH IMPROVE THE VISUAL APPEARANCE OF GRANULAR MATERIALS

[75] Inventors: Michael Chris Jensen; Scott Alan Walters, both of Cincinnati, Ohio

[73] Assignee: The Procter & Gamble Company, Cincinnati, Ohio

[21] Appl. No.: 09/286,525

[22] Filed: Apr. 6, 1999

[51] Int. Cl.[7] ..... B65D 85/00

[52] U.S. Cl. ..... 206/459.1; 206/778

[58] Field of Search ..... 206/77.1, 459.1, 206/459.5, 524.1, 776, 778

[56] References Cited

U.S. PATENT DOCUMENTS

| | | | |
|---|---|---|---|
| 3,646,015 | 2/1972 | Hamilton | 252/301.22 |
| 3,966,755 | 6/1976 | Schlapfer | 252/301.27 |
| 5,226,538 | 7/1993 | Roselle | 206/459.1 |
| 5,711,476 | 1/1998 | Fujimoto et al. | 482/5 |
| 5,728,671 | 3/1998 | Rohrbaugh et al | 8/647 |
| 5,834,412 | 11/1998 | Rohrbaugh et al. | 510/324 |

*Primary Examiner*—David T. Fidei
*Attorney, Agent, or Firm*—James C. Vago

[57] ABSTRACT

A package for a granular material, such as a laundry detergent, is provided. The package includes a closed bottom container for storing the granular material and an opening through which the granular material can be viewed. A radiant structure, such as a paperboard liner, is disposed within at least a portion of the container. The radiant structure has a radiant structure characteristic, such as the spectrophotometric curve of the radiant structure. The radiant structure characteristic is selected to produce a predetermined shift of a radiant material characteristic of the granular material, such as a shift in the spectrophotometric curve of the granular material.

20 Claims, 5 Drawing Sheets

PACKAGES WHICH IMPROVE THE VISUAL APPEARANCE OF GRANULAR MATERIALS

TECHNICAL FIELD OF THE INVENTION

The present invention relates to the field of packages for granular materials, and, more particularly, to the field of packages which improve the visual appearance of granular materials stored therein.

BACKGROUND OF THE INVENTION

Paperboard cartons for storing granular materials, such as laundry detergents, are known in the art. These cartons can comprise a closed bottom container having an opening through which the granular materials can be viewed and removed. A recloseable lid covers the opening to seal the container from the environment. Often times, the users perception of the efficacy of the granular material stored in the carton is based upon the visual appearance of the granular material. For example, users of granular laundry detergents often gauge the detergents effectiveness by the color of the detergent, wherein the more white the color, the more effective the detergent is perceived to be. While dyes and optical brighteners can be used to adjust the color of a laundry detergent, various types of lighting can still affect the visual appearance of the laundry granules. Still further, there can be differences between geographic regions regarding which color, or even shade of a color, is perceived to represent an effective laundry detergent.

As such, there exists a need for simplified structures and methods for adjusting the visual appearance of granular materials without changing the composition or recipe of the granular material in order to provide more visually pleasing granular materials. Still further, there exists a need to provide simplified structures and methods for adjusting the visual appearance of a granular material by changing any one of a number of radiant characteristics of the granular material. Yet further, there exists a need to provide structures and methods which can shift the radiant characteristics of more than one granular material stored in the container.

SUMMARY OF THE INVENTION

A package for a granular material, such as a laundry detergent, is provided. The package includes a closed bottom container for storing the granular material and an opening through which the granular material can be viewed. The package can be recloseably sealed by a lid which is attached to the container by a hinge. A radiant structure, such as a paperboard liner, is disposed within at least a portion of the container adjacent the granular material. The radiant structure has a radiant structure characteristic, such as the spectrophotometric curve of the radiant structure, which is selected to produce a predetermined shift of a radiant material characteristic of the granular material, such as a shift in the spectrophotometric curve of the granular material.

The spectrophotometric curve of the radiant structure preferably has a peak reflectance between a wavelength of about 400 nm and a wavelength of about 500 nm. The spectrophotometric plot of the granular material stored in the package preferably has an CIE 1976 color scale L* value of between about 7 and about 9, an a* value of between about −1 and about +1 and a b* value of between about −8 and about −10, and the luminance intensity of at least one predetermined wavelength of the granular material is preferably increased by at least about 10% by the radiant structure. For laundry detergents comprising an optical brightener, the radiant structure reflects at least about 25% of at least one ultraviolet wavelength which excites the optical brightener to emit visible light.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1:
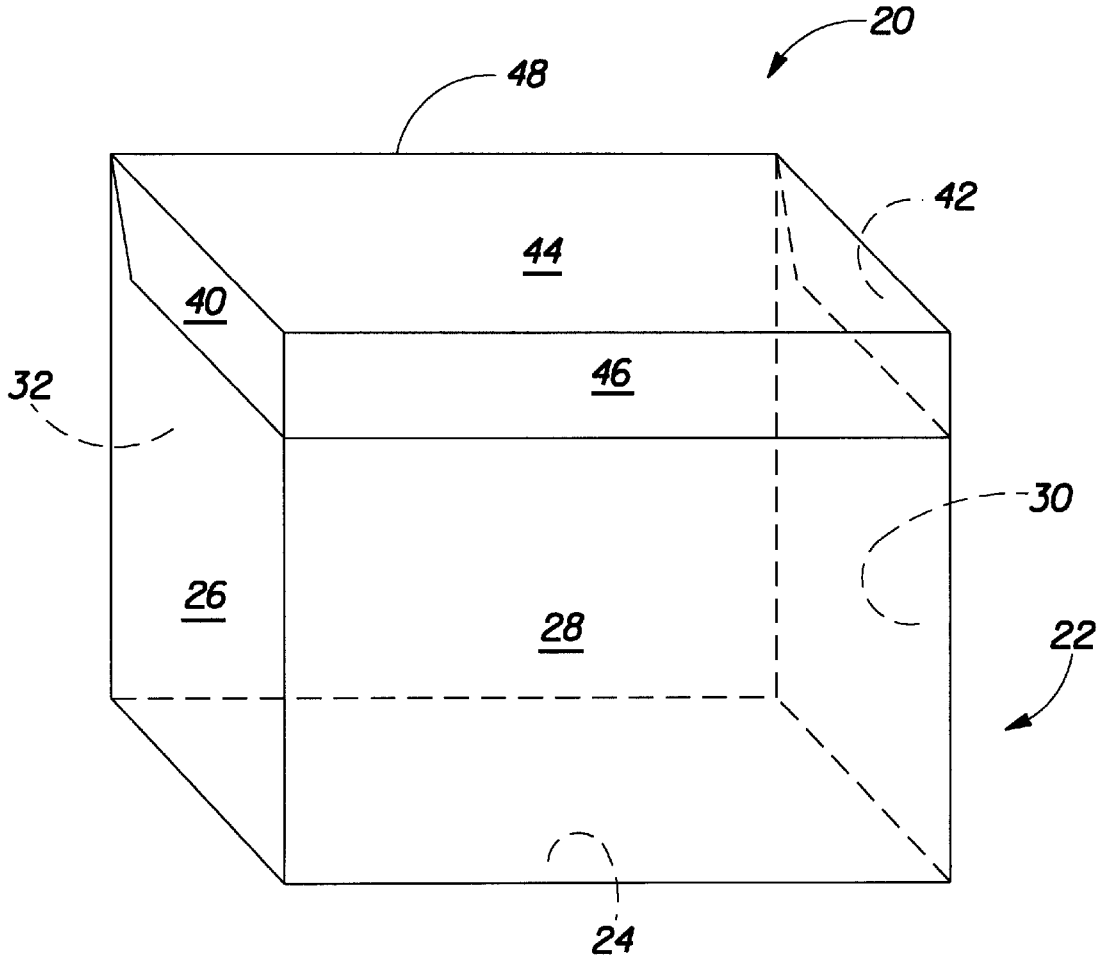
FIG. 1 is a perspective view of a package suitable for use with the present invention.
Figure 2:
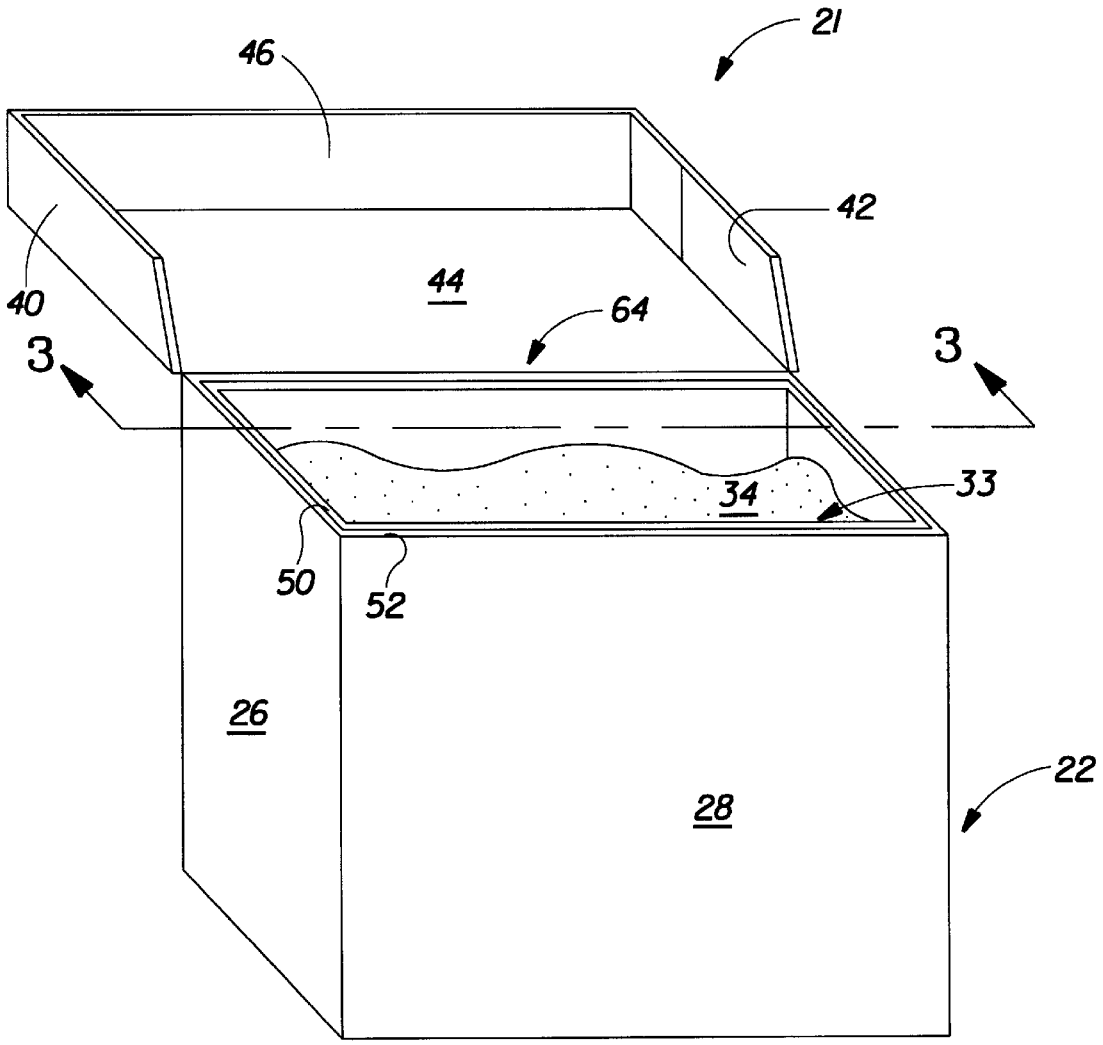
FIG. 2 is a perspective view of the package of FIG. 1, wherein the lid is in the raised position.
Figure 3:
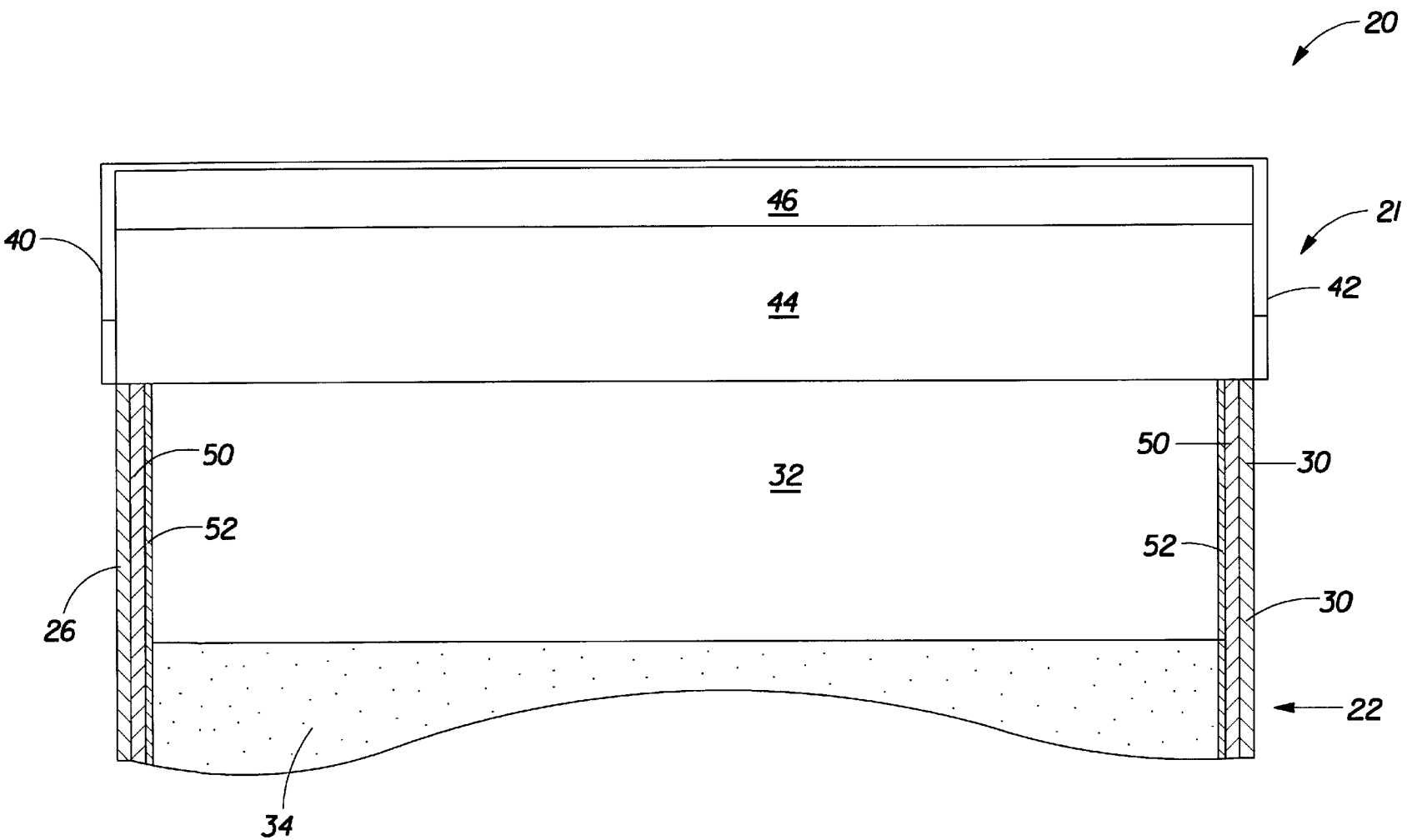
FIG. 3 is an enlarged partial cross sectional side view of the package of FIG. 1, taken along line 3—3 thereof.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements. As discussed more fully hereafter, the present invention is directed to packages for storing granular materials having a radiant structure, such as a liner, coating, or combination thereof, which is disposed about at least a portion of the interior of the package for improving the visual appearance of the granular material stored therein. An exemplary carton or package 20 made in accordance with the present invention is illustrated in FIGS. 1 to 3. The package 20 is illustrated as a six-sided parallelepiped carton having a lid 21 interconnected with a closed bottom container 22. The container 22 is formed from a base 24 and side panels 26, 28, 30 and 32. An opening 33 is disposed at the top portion of the container 22. For packages 20 which store laundry detergents, the opening 33 preferably has an area of between about 160 $cm^2$ and about 470 $cm^2$ for packages having a volume of between about 2,400 $cm^3$ and about 10,700 $cm^3$, respectively. The granular material 34 stored within the container 22 can be both viewed and removed through the opening 33 when the lid 21 is in the raised position. The lid, base and side panels each have inner and outer surfaces, wherein the inner surfaces are disposed within the interior of the package 20 and the outer surfaces are disposed about the exterior of the package (the outer surfaces only being visible in FIG. 1). The lid 21 and container 22 can be formed from a variety of materials, including, but not limited to, plastics, cardboard, or a cardboard which is laminated or coated with a moisture barrier material, such as polyethylene, polypropolyene, varnish or other moisture resistant materials known in the art. While the present invention will be described hereafter with respect to the exemplary package 20 for ease of discussion, it will be appreciated that the present invention can be adapted for use with other shaped packages, such as that described in U.S. Pat. No. 5,711,476 which is hereby fully incorporated herein by reference, as well as flexible packages such as bags, pouches and the like. Further, the present invention can be used with packages having one or more curved or curvilinear panels as well as top fill and side fill packages.

The lid 22 includes side lid flaps 40 and 42, a top lid flap 44 and a front lid flap 46. The lid 22 is connected to the side panel 32 by a hinge 48, which is disposed between the top lid flap 44 and the side panel 32, so that the lid 22 can be raised and lowered, thereby exposing or sealing the interior of the container 21 from the environiment. As will be appreciated, the hinge 48 can be integrally formed with the lid 22 and side panel 32 or can be provided as a separate structure, as is known in the art. The side and front lid flaps 40, 42 and 46 overlap with the side panels 26, 28 and 30, respectively, when the lid 22 is in the closed or lowered position. While the package 20 is illustrated in FIG. 1 with the lid 22 disposed at the top of the carton, it is contemplated that the lid 22 can be placed at other locations, multiple lids can be provided and other lid configurations can be accommodated. The lid and various panels of the container 21 can be formed as is known in the art. In addition, the container 21 and lid 22 can comprise various closure structures for recloseably securing the lid and container.

The package 20 is preferably used to store a powdered or granular material 34 (FIGS. 2 and 3), and, more preferably, is used to store laundry detergents or other cleaning products. Most preferably, the package 20 is used to store a laundry detergent comprising one or more optical brighteners or fluorescent whiteners. For the purposes of the present invention the terms "optical brighteners" and "fluorescent whiteners" are use interchangeably and are taken to mean organic compounds which absorb the invisible ultraviolet (UV) portion of the daylight spectrum and convert this energy into the longer-wavelength visible position of the spectra. Fluorescent whitening, therefore, is based on the addition of light, whereas the older methods such as "blueing" is achieved by subtraction of light by the addition of blue or blue-violet dyes to textiles.

The herein disclosed optical brighteners produce additional visible light by means of fluorescence. The optical brighteners can be added not only for the enhancement of the treated fabric, but to provide an aesthetic quality to the laundry detergent composition itself, because the presence of one or more optical brighteners can enhance the whiteness of a granular material. Alternatively, the granular material might include a visual signal that an adjunct ingredient is present. For example, small colored inert speckles can be added to the granular material to signal to the consumer that the composition comprises bleach. The presence of optical brighteners may act to enhance the contrast between the white "background" of the detergent and the colored speckles thus allowing the use of less colored indicator. When present, the compositions of the present invention will comprise from about 0.01% to about 5%, preferably to about 2.5%, more preferably to about 2% by weight, of one or more optical brighteners.

Typically comprised of small highly fluorescent molecules, optical brighteners are primarily modified to promote increased water solubility of the core organic structure, however, optical brightener benefits can be delivered by polymeric materials inter alia soil release polymers comprising fluorescent whitening groups as disclosed in U.S. Pat. No. 5,728,671 Rohrbaugh et al., issued Mar. 17, 1998 and U.S. Pat. No. 5,834,412 Rohrbaugh et al., issued Nov. 10, 1998 both of which are incorporated herein by reference.

The following are non-limiting examples of fluorescent whitener agents suitable for use in the granular material 34:

a) Distyryl-biphenyl (DSBP) optical brighteners which can be mono- or polysulfonated, said DSBP brighteners having the formula:

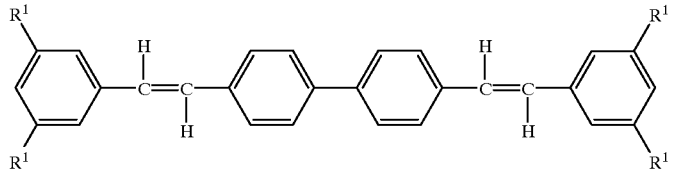

wherein each $R^1$ is independently hydrogen, —$SO_3M$, —CN, Cl, $OCH_3$, —$C(O)OCH_3$, —$SO_2N(R^2)_2$, —$C(O)N(R^2)_2$, and mixtures thereof; wherein each $R^2$ is independently $C_1$–$C_8$ alkyl, M is hydrogen or a salt forming cation, preferably sodium, potassium, lithium, and mixtures thereof; provided at least one $R^1$ units is a —$SO_3M$ units wherein M is a salt forming cation. Non-limiting examples of DSBP optical brighteners include Tinopal CBS-X® available ex Ciba-Geigy.

b) Triazinyl stilbene optical brighteners which can be mono- or polysulfonated, said triazinyl brighteners having the formula:

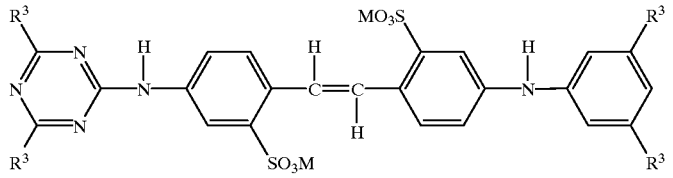

wherein each $R^3$ is independently selected from the group consisting of:

i) phenyl amino having the formula:

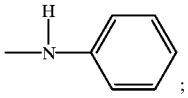

;

ii) sulphonyl substituted phenyl amino having the formula:

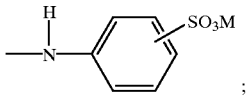

iii) di-sulphonyl substituted phenyl amino having the formula:

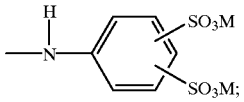

iv) carboxy substituted phenyl amino having the formula:

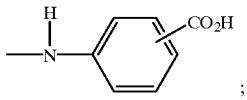

v) morpholinyl having the formula:

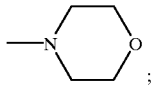

vi) alkylenemethoxy amino having the formula:

$—NH(CH_2)_{2-3}OCH_3$;

vii) 2-hydroxyethylamino;
viii) di-(2-hydroxyethyl)amino;
ix) chloro;
x) hydrogen;
xi) amino;
xii) methoxy;
xiii) alkylenesulphonyl amino;
xiv) $—NHR^4$;
xv) $—N(R^4)_2$;

wherein each $R^4$ is independently $C_1$–$C_8$ alkyl, M is hydrogen or a salt forming cation, preferably sodium, potassium, lithium, and mixtures thereof. Non-limiting examples of triazinyl stilbene optical brighteners include Tinopal 5-BMX® available ex Ciba-Geigy. See U.S. Pat. No. 3,954,740 Fringeli, issued May 4, 1976 incorporated herein by reference.

c) triazolyl stilbenes optical brighteners which can be mono- or polysulfonated, said triazolyl brighteners having the formula:

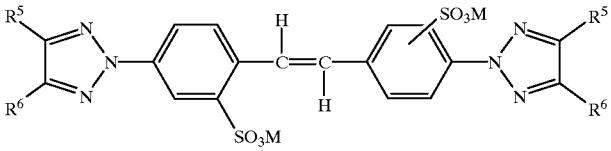

wherein each $R^5$ and $R^6$ is independently selected form the group consisting of hydrogen, chlorine, $—NHCH_3$, $—N(CH_3)_2$, $—SO_3M$, $—SO_3NH_2$, $—SO_3N(R^7)_2$, $—SO_3C_6H_5$, $—OCH_3$, —CN, $—CON(R^7)_2$, and mixtures thereof; each $R^7$ is independently $C_1$–$C_8$ alkyl, M is hydrogen or a salt forming cation, preferably sodium, potassium, lithium, and mixtures thereof. Non-limiting examples of triazinyl stilbene optical brighteners include Blankophor BHC® available ex Mobay.

d) naphthotriazolyl stilbenes optical brighteners which can be mono- or polysulfonated, said naphthotriazolyl brighteners having the formula:

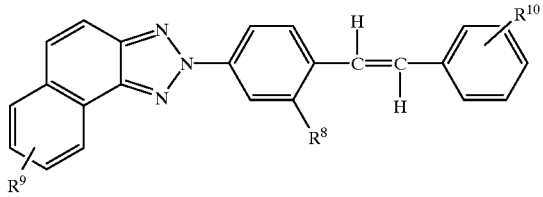

wherein $R^8$ is selected from the group consisting of hydrogen, $—SO_3H$, $—SO_3NH_2$, $—SO_3C_6H_5$, —CN, and mixtures thereof; $R^9$ is selected from the group consisting of hydrogen, $—SO_3M$, —CN, chlorine, $—OCH_3$, $—NHCH_3$, $—N(R^{11})_2$, $—SO_3NH_2$, $—SO_3C_6H_5$, $—SO_3N(R^{11})_2$, $—CO_2CH_3$, $—CON(R^{11})_2$, and mixtures thereof; $R^{10}$ is selected from the group consisting of hydrogen, $—SO_3H$, $—OCH_3$, and mixtures thereof; each $R^{11}$ is independently $C_1$–$C_8$ alkyl, M is hydrogen or a salt forming cation, preferably sodium, potassium, lithium, and mixtures thereof, provided at least one $R^8$, $R^9$, or $R^{10}$ is $—SO_3M$. Non-limiting examples of naphthotriazolyl stilbenes optical brighteners includes Tinopal RBS® ex Ciba-Geigy.

e) Diarylpyrazolines having the formula:

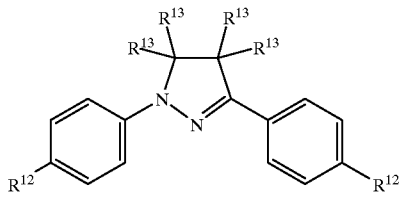

wherein each $R^{12}$ is independently hydrogen, $—SO_3M$, —CN, chlorine, $—OCH_3$, $—NHCH_3$, $—N(R^{14})_2$, $—SO_3NH_2$, $—SO_3C_6H_5$, $—SO_3N(R^{14})_2$, $—CO_2CH_3$, $—CON(R^{14})_2$, and mixtures thereof, each $R^{13}$ is independently hydrogen, $C_1$–$C_8$ alkyl, aryl, and mixtures thereof, preferred aryl is substituted and unsubstituted phenyl, biphenyl, naphthyl, said substitution is selected form the group consisting of $—SO_3M$, —CN, chlorine, $—OCH_3$, $—NHCH_3$, $—N(R^{14})_2$, $—SO_3NH_2$, $—SO_3C_6H_5$, $—SO_3N(R^{14})_2$, $—CO_2CH_3$, $—CON(R^{14})_2$, and mixtures thereof; each $R^{14}$ is independently $C_1$–$C_8$ alkyl, M is hydrogen or a salt forming cation, preferably sodium, potassium, lithium, and mixtures thereof. See U.S. Pat. No. 3,962,116 Bloching et al., issued Jun. 8, 1976 incorporated herein by reference.

f) Coumarins having the formula:

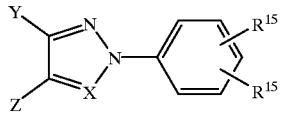

wherein each $R^{15}$ is independently hydrogen, halogen, $C_1$–$C_4$ alkyl, $C_1$–$C_4$ alkylsulphonate, $C_1$–$C_4$ alkoxy, and mixtures thereof; X is nitrogen or —CH═; Y is hydrogen, chlorine, methyl, and mixtures thereof; Z is a coumarin comprising radical having the formula:

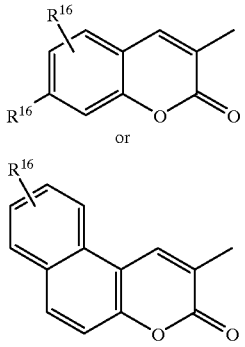

wherein each $R^{16}$ is independently $C_1$–$C_{12}$ alkoxy, $C_2$—$C_2$ alkenyloxy, benzyloxy, said benzyloxy optionally substituted with halogen, methyl, methoxy, and mixtures thereof. For a further description of coumarins which are suitable for use as optical brighteners in the present invention see U.S. Pat. No. 3,966,755 Schl äpfer, issued Jun. 29, 1976. In addition, see U.S. Pat. No. 3,646,015 Hamilton, issued Feb. 29, 1972 and U.S. Pat. No. 4,483,780 Llenado, issued Nov. 20, 1984 both of which are incorporated herein by reference.

In accordance with one aspect of the present invention, the package 20 further comprises a radiant structure, such as liner 50, which is disposed about at least a portion of the interior of the package 20. As discussed more fully hereafter, one or more of the radiant characteristics of the radiant structure are selected to produce a predetermined shift or change in one or more radiant characteristics of the granular material 34. As used herein, the phrase "radiant characteristic" and its derivatives is intended to refer to a property of a structure or material which affects or quantifies the type, quality or amount of electromagnetic radiation (e.g., visible and/or invisible light) radiated (e.g., emitted, reflected, transmitted, or absorbed) by the structure or material under a fixed set of lighting and geometric or orientation conditions. For example, the spectrophotometric curve (i.e., the color of a structure or material as a function of the wavelength composition of the electromagnetic radiation) and luminance intensity (candela/m2) of a structure or material are considered radiant characteristics herein. Other radiant characteristics can include the various indexes which have been established in the art to characterize the type, quality or amount of light radiated from an object, such as the whiteness index, brightness index, and the CIE 1976 L* a* b* color index. Whenever radiant characteristics are compared herein, it is assumed that the comparison is made using substantially similar light sources and geometric conditions relative to the structure or material.

The liner 50 preferably extends from adjacent the top edge 52 of the container 22 to the base 24. The radiant characteristics of the liner 50 are selected to modify one or more radiant characteristics of the granular material 34 so that it is more appealing to a user of the material without altering the chemical composition of the material. For example, users of the granular material 34 might prefer a granular material having a slightly different hue than that presented by the material, in which case the liner 50 can be selected to provide a predetermined shift in the hue of the granular material 34 by its radiant interaction with the material, as discussed more fully hereafter.

Figure 4:
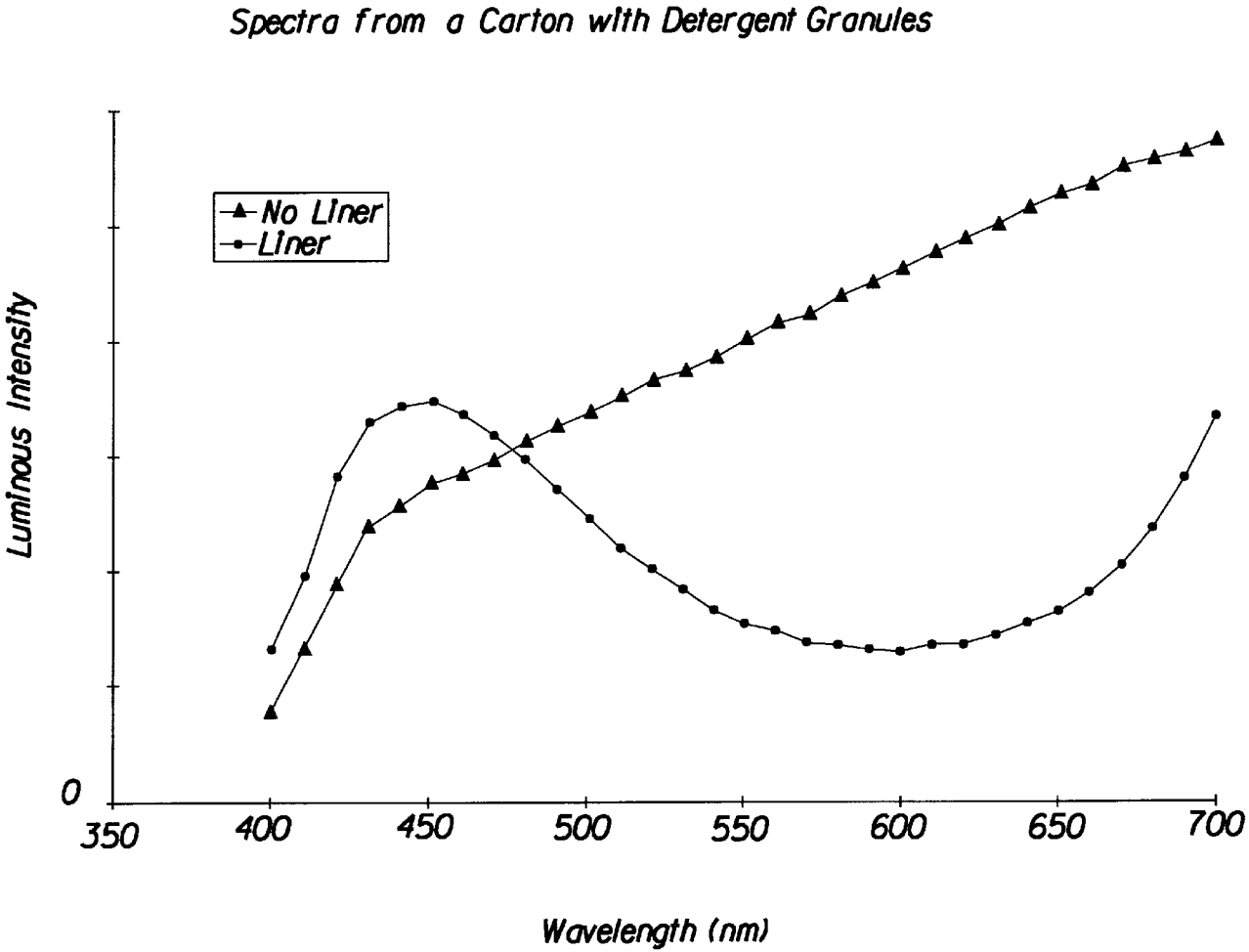
FIG. 4 is an spectrophotometric plot of the radiated light from an exemplary laundry detergent in a package with and without a liner.

When it is desired to selectively modify the spectrophotometric curve of the granular material 34, it is useful to first characterize the visible light radiated from the granular material prior to selecting the appropriate liner 50 which will shift the spectrophotometric curve of the granular material. The radiated light can be characterized using any one of several instruments known in the art. For example, optical sensors, such as the COLORQUEST® 45/0 Spectrocolorimeter manufactured by Hunter Associates Laboratory, Inc. of Reston, Va., can be used to determine the spectrophotometric curve for a granular material. FIG. 4 illustrates several spectrophotometric plots for the radiant visible light from an exemplary granular laundry detergent in a package with and without a liner 50. The package 20 which is the subject of the plots of FIG. 4 has a height of 17 cm, a depth of about 13 cm and a length of about 22 cm, wherein the depth and length dimensions also defined the opening 33 of the container 22. This package is centered below the light source of the COLORQUEST® 45/0 Spectrocolorimeter with the lid in the raised position so that the laundry detergent is visible through the opening of the container, wherein the granular material disposed within the container is positioned about 10 cm below the aperture of the light source. The spectral plots of FIG. 4 can also be characterized according to one of several color measurement scales, such as the CIE 1976 L*a* b* scale. The CIE 1976 L*a* b* scale is a simplified cube root version of the Adams-Nickerson space produced by plotting the quantities of L*, a* and b* in rectangular coordinates. L* measures lightness and varies from a value of one hundred for perfect white to zero for black while a* measures redness when positive, gray when zero and greenness when negative. The value of b* measures yellowness when positive, gray when zero and blueness when negative. The spectral plot of the light reflected from a laundry detergent in a package without a liner can be also represented in the rectangular coordinates of the CIE 1976 L*a* b* color scale with an L* value between about 13.5 and about 17.5, a* values of between about 0.5 and about 2.5, and b* values of between about 6 and about 7. More preferably, the spectral plot of the light reflected from a laundry detergent in a package without a liner can be also represented in the rectangular coordinates of the CIE 1976 L*a* b* color scale with an L* value of about 16, a* value of about 1.5 and b* value of about +7, these latter L*, a*, b* values are also plotted in FIG. 5 and correspond to the spectral plot for the package without a liner which is the subject of FIG. 4. As will be appreciated, the magnitudes of the L*, a* and b* values can vary depending upon lighting conditions; however, it is believed that the relationship between the values is a characteristic of the material which is analyzed. For comparison, laundry detergents when measured alone (i.e., not in a package 20) have L* values of between about 80 and about 97, a* values of between about −4 and about +4, and b* values of between about −8 and about +8.

Figure 5:
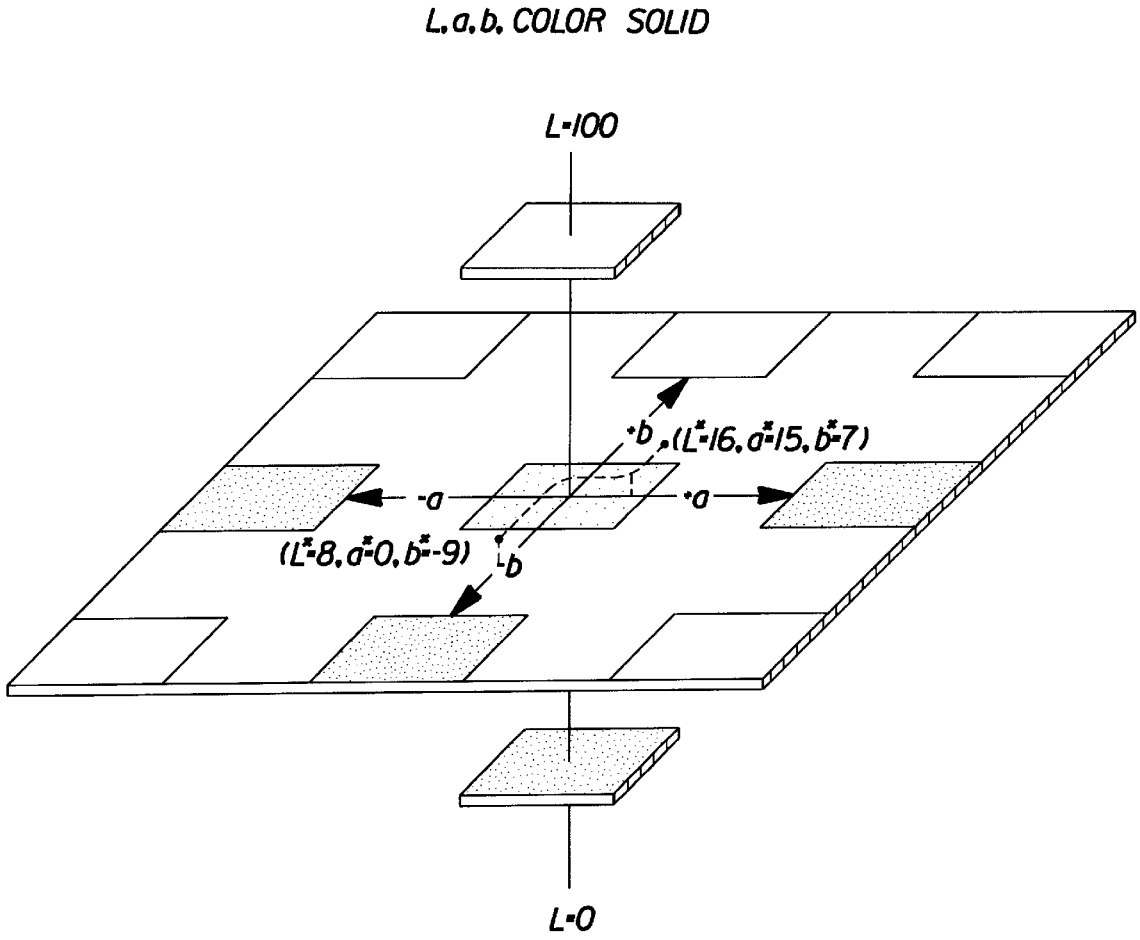
FIG. 5 is a CIE 1976 L*a*b* color plot of the spectrophotometric plot of FIG. 4.

As previously discussed, the liner 50 is preferably selected to adjust a radiant characteristic of the granular material 34 stored within the package 20. Referring to FIGS. 4 and 5, selection of the liner 50 will now be discussed with respect to an exemplary laundry detergent. As illustrated in FIG. 4, a package 20 with a granular laundry detergent but without a colored liner can have a spectral plot with steadily increasing luminous intensity from 400 nm (violet) to 700 nm (red). However, laundry granules stored in the same package 20 with a "dark blue" liner 50 produce a distinct peak between about 430 nm and about 460 nm. In other words, the "dark blue" liner 50 produced a favorable shift in the spectrophotometric plot of the laundry detergent granules stored within the package 20. For laundry detergents, the radiant structure (e.g., liner 50) is preferably blue in color, and, more preferably, the radiant structure has a spectrophotometric plot with a peak in the luminous intensity between about 400 nm and about 500 nm when the liner 50 is measured alone using an optical sensor such as the COLORQUEST® 45/0 Spectrocolorimeter. More preferably, the radiant structure has a peak in the luminous intensity between about 430 nm and about 460 nm. For laundry detergents, the liner 50 preferably adjusts the spectrophotometric curve of the granules when viewed through the opening of the package so that the granules have an L* value between about 7 and about 9, an a* value between about −1 and +1 and a b* value between about −8 and about −10 when measured according to any one of the standard color measurement tests, such as the test described in TAPPI 524 om-94 published by the Technical Association of the Pulp and Paper Industry. More preferably, the laundry granules have an L* value of about 8, an a* value of about 0 and a b* value of about −9 when the laundry granules are viewed through the opening of a package 20 having a colored liner 50. These latter values are plotted in FIG. 5 and correspond to the spectral plot for the package and liner which are the subject of FIG. 4. A blue colored liner can also beneficially affect the florescence of optical brighteners disposed in the granular material 34 because of the proximity of visible blue wavelengths to the ultraviolet spectrum. While the liner 50 is preferably provided with a uniform color throughout, it is contemplated that the liner 50 can be provided with varying shades of color as a function of the depth of the liner from the opening 33, with multiple colors and/or patterns of colors to achieve the desired shift in one or more radiant characteristics of the granular material 34.

In addition to selecting the liner 50 with the appropriate spectrophotometric distribution, the liner 50 can be selected to provide diffuse reflection (i.e., the visible light is redirected from the liner 50 over a range of angles) or specular reflection (i.e., the visible light is redirected in highly directional manner). The liner 50 preferably reflects at least about 50% and, more preferably, about 75%, of the visible light between about 400 nm and about 500 nmn. Due to the liner 50, the luminance intensity of the visible light which radiates from the granular material 34 (either by reflection or emission) preferably increases by at least about 10% for at least one visible wavelength. More preferably, the luminance intensity of the visible light which radiates from the granular material 34 (either by reflection or emission) preferably increases by at least about 25% for at least one visible wavelength between about 400 nm and about 500 nm and, most preferably, the luminance intensity of the visible light which radiates from the granular material increases by at least about 50% for at least one visible wavelength between about 400 nm and about 500 nm. As used herein, the phrase "luminance intensity" is intended to refer to the intensity or spectral energy of a radiated wavelength and can be measured in units of candela/$m^2$.

Still further, the liner 50 can be selected for its radiant characteristics in the non-visible wavelengths, particularly the ultraviolet wavelengths between about 200 nm and about 400 nm and, more preferably, between about 300 nm and about 400 nm. In other words, the structure (e.g., materials, coatings, etc.) and color of liner 50 are selected to optimize the reflectance of ultraviolet wavelengths onto the granular material 34 in order to activate any optical brighteners disposed therein. The liner 50 preferably reflects at least about 25%, and, more preferably, at least about 50% of at least one ultraviolet wavelength which excites an optical brightener of the granular material 34 to emit visible light. Most preferably, the liner 50 reflects about 75% of at least one wavelength in the ultraviolet spectrum which excites an optical brightener of the granular material 34 to emit visible light.

When the granular material is a laundry detergent, luminance intensity can be characterized according to the brightness of the granular material per the test procedure set forth in TAPPI T452om-98 published by the Technical Association of the Pulp and Paper Industry. As discussed therein, the brightness is a numerical value of the reflectance factor with respect to blue light (e.g., between about 400 nm and about 510 nm) of specific spectral and geometric characteristics. As such, the brightness test is intended to characterize the luminance intensity with respect to wavelengths within the blue spectrum. The higher the blue light reflectance, generally the whiter the granular material will appear. As such, the TAPPI T452-om98 test provides a single-number index for comparing white materials. If the laundry detergent contains optical brighteners, a higher brightness reading will be obtained than if no optical brighteners were present. Preferably, the liner 50 increases the brightness index, when measured according to the TAPPI T452-om98 test, of a granular material 34 stored in a package 20 by at least about 10% and, more preferably, by at least about 25% when compared to the granular material in a package 20 without the liner 50. Most preferably, the liner 50 increases the brightness index by at least about 50% when compared to the granular material in a package 20 without the liner 50

Another index for characterizing the appearance of granular materials, such as laundry detergents, is the whiteness index referenced in ASTM E313. The whiteness index provides a rating of the yellowness or whiteness of white or near white specimens. Whiteness is associated with a region in color space in which objects are recognized as white. The degree of whiteness is measured by the degree of departure of the specimen from a perfect white. Preferably, the liner 50 increases the whiteness index of the granular material stored within the package 20 by at least about 25% and, more preferably, by at least about 50% when compared to the granular material in a package 20 without the liner 50. Most preferably, the liner 50 increases the whiteness index of the granular material stored within the package 20 by at least about 75% when compared to the granular material in the package 20 without the liner 50.

The liner 50 can be formed from paperboard, foil, or the like and attached to the interior of the container 22 by a suitable adhesive. The liner 50 can further comprise one or more coatings, such as an ultraviolet reflective coating, which can simultaneously affect more than one radiant characteristic of the granular material 34. For example, the ultraviolet reflectance of the liner 50 can affect the visible light emitted by laundry granules while the visible color of the liner 50 can further affect the radiant characteristic of the visible light radiated by the granular material 34. In addition, the visible color of the liner 50 might be selected to enhance a second granular material stored in the package 20 along with the granular material 34 and which is distinct from the granular material. The second granular material can be distinct, for example, in size, composition, color, granular geometry, etc. The color of the liner 50 might be selected to enhance the visual appearance of speckles in a laundry detergent while the ultraviolet radiant characteristic of the liner is selected based upon the optical brighteners disposed in the laundry detergent. While the liner 50 has been discussed herein by way of example, it will be appreciated that a coating (e.g., an ink, thin polymer film, etc.) can be directly applied to the interior of the container 22 in place or in combination with a paperboard liner 50. Still further, optical brighteners can be added to the liner 50 to further enhance the type and quantity of visible light which is radiated toward the granular material 34.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A package, comprising:

a first granular material having a first radiant material characteristic;

a container storing said first granular material having an opening through which said first granular material can be viewed; and and a radiant structure disposed within at least a portion said container, wherein said radiant structure has a first radiant structure which is selected to produce a predetermined shift of the first radiant material characteristic of said first granular material.

2. The package of claim 1, wherein said radiant structure is a liner which is attached to at least a portion of the interior of said container.

3. The package of claim 1, wherein said first radiant structure characteristic is the spectrophotometric curve of said radiant structure.

4. The package of claim 3, wherein the spectrophotometric curve of said radiant structure has a peak reflectance between a wavelength of about 400 nm and a wavelength of about 500 nm.

5. The package of claim 1, wherein said first radiant material characteristic of said first granular material is the spectrophotometric curve of said first granular material.

6. The package of claim 5, wherein the spectrophotometric curve of said first granular material has an L* value of between about 7 and about 9, an a* value of between about −1 and about +1 and a b* value of between about −8 and about −10.

7. The package of claim 1, wherein said first granular material is a laundry detergent.

8. The package of claim 7, wherein said laundry detergent comprises a between about 0% and about 5% of an optical brightener.

9. The package of claim 8, wherein said radiant structure has a second radiant structure characteristic which is selected to produce a predetermined shift of a second radiant material characteristic of said first granular material.

10. The package of claim 9, wherein said second radiant material characteristic of said first granular material is the luminance intensity of said first granular material.

11. The package of claim 10, wherein the luminance intensity of said first granular material is increased by at least about 10% by said radiant structure.

12. The package of claim 8, wherein the said radiant structure reflects at least about 25% of at least one ultraviolet wavelength which excites said optical brightener to emit visible light.

13. The package of claim 12, wherein said radiant structure further comprises a reflective ultraviolet coating.

14. The package of claim 7, further comprising a second granular material stored within said container which is distinct from said first granular material, wherein said second granular material has a first radiant material characteristic.

15. The package of claim 14, wherein said radiant structure has a second radiant structure characteristic which is selected to produce a predetermined shift of said radiant material characteristic of said second granular material.

16. A package, comprising:

a laundry detergent having a first radiant material characteristic, wherein said laundry detergent comprises between about 0% and about 5% of an optical brightener;

a closed bottom container storing said first granular material having an opening through which said first granular material can be viewed; and and a radiant structure disposed within said container, wherein said radiant structure has a first radiant structure characteristic which is selected to produce a predetermined shift of the first radiant material characteristic of said laundry detergent.

17. The package of claim 16, wherein said radiant structure is a liner which is attached to at least a portion of the interior of said container and wherein said first radiant structure characteristic is the spectrophotometric curve of said liner, the spectrophotometric curve of said liner having a peak reflectance between a wavelength of about 400 nm and a wavelength of about 500 nm.

18. The package of claim 17, wherein said first radiant material characteristic of said laundry detergent is the spectrophotometric curve of said laundry detergent and wherein the spectrophotometric curve of said laundry detergent has an L* value of between about 7 and about 9, an a* value of between about −1 and about +1 and a b* value of between about −8 and about −10.

19. The package of claim 17, wherein said liner reflects at least about 25% of at least one ultraviolet wavelength which excites said optical brightener to emit visible light.

20. The package of claim 19, wherein the luminance intensity of said laundry detergent is increased by at least about 10% by said liner.

* * * * *

UNITED STATES PATENT AND TRADEMARK OFFICE

CERTIFICATE OF CORRECTION

PATENT NO. : 6,026,956
DATED : February 22, 2000
INVENTOR(S) : M.C. Jensen et al.

It is certified that error appears in the above-identified patent and that said Letters Patent is hereby corrected as shown below:

Column 11,
Line 36, delete "and".
Line 36, after "portion" insert -- of --.
Line 36, after "structure" insert -- characteristic --.

Column 12,
Line 36, delete "and".

Signed and Sealed this

Thirteenth Day of November, 2001

*Attest:*

Nicholas P. Godici

NICHOLAS P. GODICI
*Acting Director of the United States Patent and Trademark Office*

*Attesting Officer*